US011127356B2

(12) United States Patent
Li et al.

(10) Patent No.: US 11,127,356 B2
(45) Date of Patent: Sep. 21, 2021

(54) METHOD FOR COMPENSATING BRIGHTNESS UNEVENNESS OF A DISPLAY DEVICE AND RELATED DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Qifeng Li, Beijing (CN); Chuanyan Lan, Beijing (CN); Yong Yu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 50 days.

(21) Appl. No.: 16/642,653

(22) PCT Filed: Jan. 4, 2019

(86) PCT No.: PCT/CN2019/070443

§ 371 (c)(1),
(2) Date: Feb. 27, 2020

(87) PCT Pub. No.: WO2020/140277

PCT Pub. Date: Jul. 9, 2020

(65) Prior Publication Data

US 2021/0134246 A1 May 6, 2021

(51) Int. Cl.
*G09G 3/3275* (2016.01)

(52) U.S. Cl.
CPC ... *G09G 3/3275* (2013.01); *G09G 2320/0233* (2013.01); *G09G 2320/0257* (2013.01);
(Continued)

(58) Field of Classification Search
CPC ..... G09G 3/3208–3291; G09G 2320/0233
See application file for complete search history.

(56) References Cited

U.S. PATENT DOCUMENTS 9,591,720 B2 * 3/2017 Asamura ..... H05B 47/16
9,715,850 B2 * 7/2017 Xie ..... G09G 3/3225
(Continued)

FOREIGN PATENT DOCUMENTS

CN 101765874 A 6/2010
CN 102768821 A 11/2012
(Continued)

OTHER PUBLICATIONS

PCT International Search Report, Application No. PCT/CN2019/070443, dated Sep. 30, 2019, 7 pages: with English translation.
(Continued)

*Primary Examiner* — Patrick F Marinelli
(74) *Attorney, Agent, or Firm* — Armstrong Teasdale LLP

(57) ABSTRACT

Embodiments of the present disclosure relate to a method for compensating brightness unevenness of a display device. In an embodiment of the present disclosure, a display device includes a display screen, a data driving circuit, and a mainboard. The method for compensating brightness unevenness according to an embodiment of the present disclosure includes obtaining, by the data driving circuit, first brightness compensation data from the mainboard. Then, the data driving circuit adjusts image data according to the first brightness compensation data.

18 Claims, 6 Drawing Sheets

(52) U.S. Cl.
CPC ..... *G09G 2320/0285* (2013.01); *G09G 2320/045* (2013.01); *G09G 2320/0626* (2013.01); *G09G 2354/00* (2013.01); *G09G 2360/16* (2013.01)

(56) References Cited

U.S. PATENT DOCUMENTS

| | | | | |
|---|---|---|---|---|
| 10,049,614 | B2 * | 8/2018 | Peana | G09G 3/3225 |
| 10,395,587 | B2 * | 8/2019 | Wang | G09G 3/3225 |
| 10,818,217 | B1 * | 10/2020 | Hsiang | G09G 3/2007 |
| 2009/0102757 | A1 * | 4/2009 | Chiou | G09G 3/32 345/76 |
| 2013/0147693 | A1 * | 6/2013 | Bae | G09G 3/3225 345/82 |
| 2016/0253960 | A1 * | 9/2016 | Xie | G09G 3/3225 345/690 |
| 2017/0042002 | A1 * | 2/2017 | Asamura | G09G 3/00 |
| 2017/0124943 | A1 * | 5/2017 | Peana | G09G 3/3225 |
| 2018/0182285 | A1 * | 6/2018 | Wang | G09G 5/10 |
| 2018/0240404 | A1 | 8/2018 | Furihata et al. | |
| 2018/0261188 | A1 * | 9/2018 | Guo | G09G 5/10 |
| 2020/0111408 | A1 * | 4/2020 | Machida | G09G 3/20 |
| 2020/0243023 | A1 * | 7/2020 | Fan | G09G 5/10 |
| 2020/0357340 | A1 * | 11/2020 | Chu | G09G 3/3233 |
| 2020/0372861 | A1 * | 11/2020 | Ok | G09G 3/3233 |

FOREIGN PATENT DOCUMENTS

| | | | |
|---|---|---|---|
| CN | 104064141 | A | 9/2014 |
| CN | 107450878 | A | 12/2017 |
| CN | 109036265 | A | 12/2018 |

OTHER PUBLICATIONS

PCT Written Opinion, Application No. PCT/CN2019/070443, dated Sep. 30, 2019, 6 pages.: with English translation of relevant part.

* cited by examiner

METHOD FOR COMPENSATING BRIGHTNESS UNEVENNESS OF A DISPLAY DEVICE AND RELATED DISPLAY DEVICE

CROSS REFERENCE TO RELATED APPLICATIONS

This patent application is a National Stage Entry of PCT/CN2019/070443 filed on Jan. 4, 2019, the disclosure of which is incorporated by reference herein in its entirety as part of the present application.

BACKGROUND

The present disclosure relates to display technology, and in particular to a method for compensating brightness unevenness of a display device and the related display device.

Currently, an active-matrix organic light-emitting diode (AMOLED) display panel has advantages of wider angle of view, higher refreshing rate, and thinner size. However, the AMOLED display panel suffers from the brightness unevenness (mura) due to production process or long operating time or the like, resulting in residual image, which would affect display effect of the display panel. Therefore, it is necessary to compensate the brightness unevenness of the AMOLED display panel. In a conventional method for compensating brightness unevenness of the display panel (demura), brightness compensation data is calculated and generated by a display driver integrated circuit (DDIC) of the display panel and stored in an additional storage device of the DDIC.

BRIEF DESCRIPTION

Embodiments of the present disclosure provide a method for compensating brightness unevenness of a display device and the related display device.

A first aspect of the present disclosure provides a method for compensating brightness unevenness of a display device. The display device includes a display screen, a data driving circuit, and a mainboard which has first brightness compensation data for the display screen stored therein. In the method, the data driving circuit obtains the first brightness compensation data from the mainboard. Then the data driving circuit adjusts image data according to the first brightness compensation data.

In an embodiment of the present disclosure, the method may further include generating, by the mainboard, second brightness compensation data and storing the second brightness compensation data to replace the first brightness compensation data when operating time of the display screen reaches an operating time threshold. Then the data driving circuit may obtain the second brightness compensation data from the mainboard, and adjust the image data according to the second brightness compensation data.

In an embodiment of the present disclosure, the method may further include generating and storing, by the mainboard, third brightness compensation data when operating time of the display screen reaches an operating time threshold. Then the data driving circuit may obtain the first brightness compensation data and the third brightness compensation data from the mainboard, and adjust the image data according to the first and third brightness compensation data.

In an embodiment of the present disclosure, the method may further include generating, by the mainboard, second brightness compensation data and storing the second brightness compensation data to replace first brightness compensation data, in response to user input information. Then the data driving circuit may obtain the second brightness compensation data from the mainboard, and adjust the image data according to the second brightness compensation data.

In an embodiment of the present disclosure, the method may further include generating, by the mainboard, third brightness compensation data in response to user input information. Then the data driving circuit may obtain the first brightness compensation data and the third brightness compensation data from the mainboard, and adjust the image data according to the first and third brightness compensation data.

In an embodiment of the present disclosure, the user input information may indicate a start to update brightness compensation data.

In an embodiment of the present disclosure, the user input information may further indicate a region for which the brightness compensation data is to be updated.

In an embodiment of the present disclosure, generating, by the mainboard, the second brightness compensation data may include generating third brightness compensation data based on a threshold voltage drift characteristic of a driving transistor of the display screen and a light emission attenuation characteristic of a light emitting device of the display screen, and generating the second brightness compensation data based on the first brightness compensation data and the third brightness compensation data.

In an embodiment of the present disclosure, the mainboard may generate the third brightness compensation data based on a threshold voltage drift characteristic of a driving transistor of the display screen and a light emission attenuation characteristic of a light emitting device of the display screen.

In an embodiment of the present disclosure, the display screen may be divided into a plurality of compensation regions. The first brightness compensation data may be generated by obtaining a current brightness value of each of the plurality of compensation regions and generating the first brightness compensation data based on the respective current brightness values and respective desired brightness values of the plurality of compensation regions. The generated first brightness compensation data may be stored in the mainboard.

In an embodiment of the present disclosure, each of the plurality of compensation regions may correspond to one pixel unit. Obtaining the current brightness value of each of the compensation regions may include obtaining the current brightness value of each pixel unit of the display screen, determining, for each of the compensation regions, the current brightness value of the compensation region as the current brightness value of the corresponding pixel unit.

In an embodiment of the present disclosure, each of the plurality of compensation regions may correspond to a plurality of pixel units. Obtaining the current brightness value of each of the compensation regions may include obtaining the current brightness value of each pixel unit of the display screen, and determining, for each of the compensation regions, the current brightness value of the compensation region as one of an average value, a weighted average value, and a maximum value of the current brightness values of the corresponding plurality of pixel units.

In an embodiment of the present disclosure, an interface between the mainboard and the data driving circuit may employ one of a Mobile Industry Processor Interface (MIPI) protocol, a Low Voltage Differential Signal (LVDS) protocol, and an Embedded Display PORT (EDP).

A second aspect of the present disclosure provides a display device. The display device includes a display screen, a mainboard, and a data driving circuit. The mainboard is configured to store first brightness compensation data for the display screen. The data driving circuit is configured to obtain the first brightness compensation data from the mainboard, and adjust image data according to the first brightness compensation data.

In an embodiment of the present disclosure, the mainboard may be further configured to generate second brightness compensation data and store the second brightness compensation data to replace the first brightness compensation data, when operating time of the display screen reaches an operating time threshold. The data driving circuit may be further configured to obtain the second brightness compensation data from the mainboard, and adjust the image data according to the second brightness compensation data.

In an embodiment of the present disclosure, the mainboard may be further configured to generate and store third brightness compensation data, when operating time of the display screen reaches an operating time threshold. The data driving circuit may be further configured to obtain the first brightness compensation data and the third brightness compensation data from the mainboard, and adjust the image data according to the first and third brightness compensation data.

In an embodiment of the present disclosure, the mainboard may be configured to generate second brightness compensation data and store the second brightness compensation data to replace the first brightness compensation data, in response to user input information. The data driving circuit may be further configured to obtain the second brightness compensation data from the mainboard, and adjust the image data according to the second brightness compensation data.

In an embodiment of the present disclosure, the mainboard may be configured to generate third brightness compensation data in response to user input information. The data driving circuit may be further configured to obtain the first brightness compensation data and the third brightness compensation data from the mainboard, and adjust the image data according to the first and third brightness compensation data.

In an embodiment of the present disclosure, the mainboard may be configured to generate the third brightness compensation data based on a threshold voltage drift characteristic of a driving transistor of the display screen and a light emission attenuation characteristic of a light emitting device of the display screen, and generate the second brightness compensation data based on the first brightness compensation data and the third brightness compensation data.

In an embodiment of the present disclosure, the mainboard may be configured to generate the third brightness compensation data based on a threshold voltage drift characteristic of a driving transistor of the display screen and a light emission attenuation characteristic of a light emitting device of the display screen.

In an embodiment of the present disclosure, the display screen may be divided into a plurality of compensation regions. The data driving circuit may be configured to generate the first brightness compensation data by obtaining a current brightness value of each of the plurality of compensation regions and generating the first brightness compensation data based on the respective current brightness values and respective desired brightness values of the plurality of compensation regions. The generated first brightness compensation data may be stored in the mainboard.

In an embodiment of the present disclosure, each of the plurality of compensation regions may correspond to one pixel unit. The data driving circuit may be further configured to obtain the current brightness value of each of the compensation regions by obtaining the current brightness value of each pixel unit of the display screen and determining, for each of the compensation regions, the current brightness value of the compensation region as the current brightness value of the corresponding pixel unit.

In an embodiment of the present disclosure, each of the plurality of compensation regions may correspond to a plurality of pixel units. The data driving circuit may be further configured to obtain the current brightness value of each of the compensation regions by obtaining the current brightness value of each pixel unit of the display screen and determining, for each of the compensation regions, the current brightness value of the compensation region as one of an average value, a weighted average value, and a maximum value of the current brightness values of the corresponding plurality of pixel units.

BRIEF DESCRIPTION OF THE DRAWINGS

In order to illustrate the technical solutions of the embodiments of the present disclosure more clearly, drawings of the embodiments will be briefly described below. It should be appreciated that the drawings described below relate only to some embodiments of the present disclosure, rather than limiting the present disclosure, wherein throughout each one of these drawings, the same reference number indicates the same or similar part or feature.

DETAILED DESCRIPTION

Figure 1:
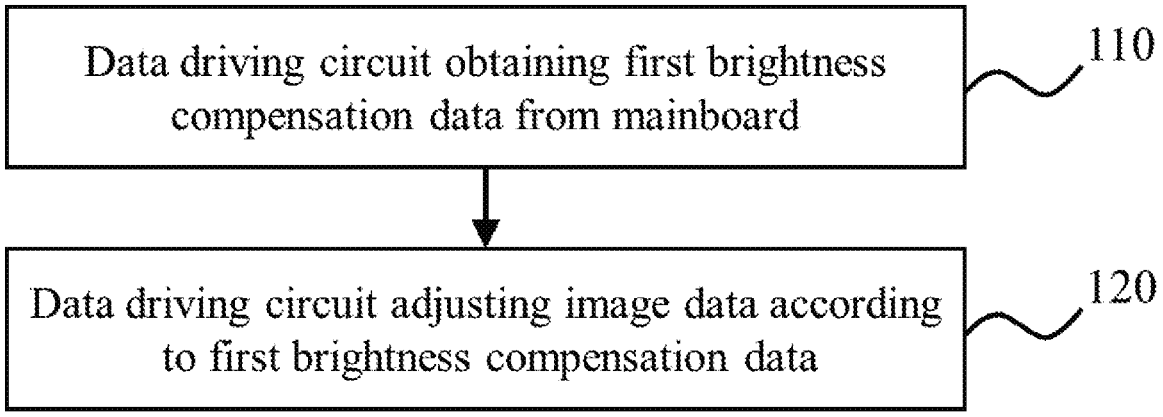
FIG. 1 is a schematic flowchart of a method for compensating brightness unevenness of a display device according to an embodiment of the present disclosure.

In order to make the technical solutions and advantages of the embodiments of the present disclosure more clear, the technical solutions in the embodiments of the present disclosure will be clearly and completely described below in detail, in conjunction with the drawings. Obviously, the described embodiments are merely some but not all of embodiments of the present disclosure. Based on the described embodiments of the present disclosure, all other embodiments obtained by those skilled in the art without creative work shall fall within the protecting scope of the present disclosure.

The terms "a", "one", "this" and "the" are intended to mean the presence of one or more elements when introducing elements and their embodiments of the present disclosure. The terms "comprising", "including", "containing" and "having" are intended to be inclusive and to indicate that there may be additional elements other than the listed elements. The flowcharts depicted in the present disclosure are merely an example. There may be many variations of the flowchart or the steps described therein without departing from the spirit of the invention. For example, the steps may be performed in a different order, or steps may be added, deleted, or modified. These variations shall be considered to be a part of what desired to claim.

Unless otherwise defined, all terms (including technical and scientific terms) used herein have the same meaning as commonly understood by those skilled in the art to which the subject matter of the present disclosure belongs. It will be further understood that terms, such as those defined in commonly used dictionaries, should be interpreted as having the meaning that are consistent with their meanings in the context of the specification and the related art and will not be interpreted in an idealized or overly formal sense unless expressly so defined herein. As employed herein, the description of "connecting" or "coupling" two or more parts together should refer to the parts being directly combined together or being combined via one or more intermediate components.

As mentioned above, in a process of manufacturing the AMOLED display panel, as the production process may cause brightness unevenness in the AMOLED display panel, it is necessary to compensate the brightness unevenness. Generally, after obtaining brightness unevenness data of the AMOLED display panel, the DDIC of the AMOLED display panel can calculate brightness compensation data and store the brightness compensation data in the additional storage device of the DDIC. When the AMOLED display panel is started, the DDIC can obtain the brightness compensation data from the additional storage device via a serial peripheral interface (SPI), and perform the brightness compensation based on the brightness compensation data. However, the additional storage device of the DDIC has a limited storage space, and the SPI interface has a rate between tens of Mbps and 200 Mbps (e.g. typically, 50 Mbps). Therefore, this limits the speed and accuracy of the brightness compensation. In addition, as the storage device must be attached to the DDIC, the cost for the display panel is higher.

In order to solve the technical problem above, the embodiments of the present disclosure provide methods for compensating the brightness unevenness of the display device. In these methods, the brightness compensation data is stored in the mainboard rather than in the additional storage device of the DDIC. Thus the space for storing the brightness compensation data can be significantly increased and the cost for the display device can be reduced.

The methods for compensating the brightness unevenness of the display device according to the embodiments of the present disclosure will be described in detail with reference to FIGS. 1 to 6.

FIG. 1 shows a schematic flowchart of a method for compensating brightness unevenness of a display device according to an embodiment of the present disclosure. In an embodiment, the display device may include a display screen, a mainboard, and a data driving circuit. In an embodiment, the display screen and the data driving circuit may be integrated into a display panel. The mainboard may be configured to have the first brightness compensation data for the display screen stored therein. The data driving circuit may be configured to drive the display screen to display an image.

As shown in FIG. 1, at step 110, the data driving circuit may obtain the first brightness compensation data from the mainboard. In an embodiment of the present disclosure, when the display device is started, the mainboard may send the first brightness compensation data to the data driving circuit, so that the data driving circuit can perform the brightness compensation. In an embodiment of the present disclosure, the mainboard may communicate with the data driving circuit via a communication protocol based interface. In an embodiment, the communication protocol may be a Mobile Industry Processor Interface (MIPI) protocol. As transmission rate of the MIPI based interface is about 1.5 Gbps, the transmission rate can be significantly increased, thereby implementing the compensation with higher accuracy. Alternatively, in some embodiments, the communication protocol may be a Low Voltage Differential Signaling (LVDS) protocol or an Embedded Display PORT (EDP) protocol.

In an embodiment of the present disclosure, the first brightness compensation data may be a grey-level lookup table in which a correspondence between an original grey value and a compensated grey value is recorded. In an embodiment of the present disclosure, the original grey value may include a plurality of sample grey values. The sample grey value may be a predetermined grey value. In some embodiments of the present disclosure, the original grey value may include all grey values in a grey-scale level supported by the display device, for example, all grey values 0 to 255 in 8 bit grey-scale. In an embodiment of the present disclosure, the first brightness compensation data may be generated in advance and stored in the mainboard. The generation of the first brightness compensation data will be described below with reference to FIG. 2.

Figure 2:
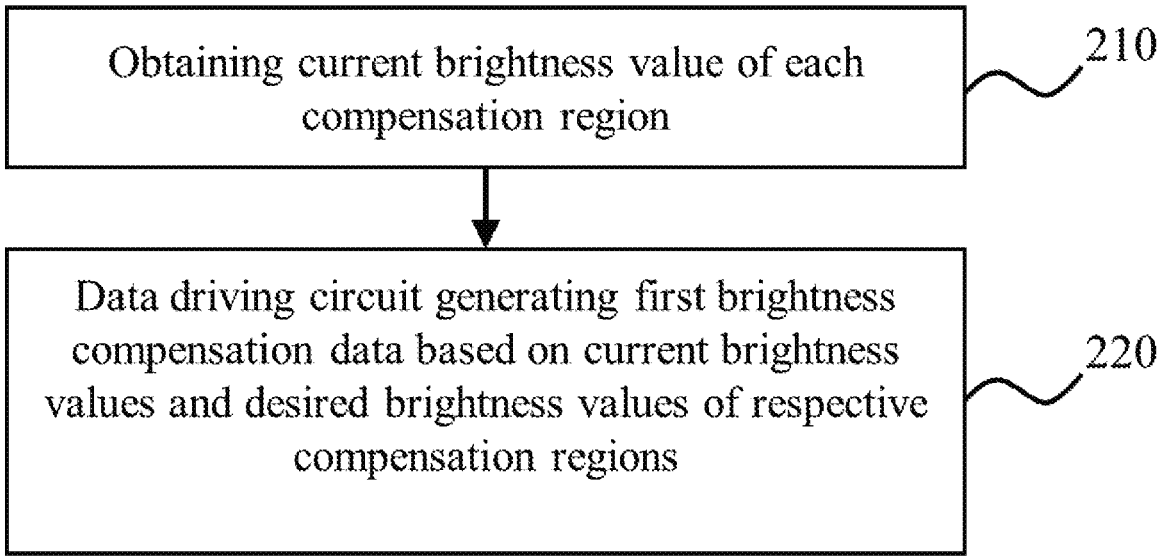
FIG. 2 is a schematic flowchart of a process for generating the first brightness compensation data according to an embodiment of the present disclosure.

FIG. 2 illustrates a process of generating the first brightness compensation data. In an embodiment of the present disclosure, the first brightness compensation data may be generated by the data driving circuit and stored in the mainboard. In an embodiment of the present disclosure, the display screen may be divided into a plurality of compensation regions, and each of the plurality of compensation regions may include at least one pixel unit.

As shown in FIG. 2, at step 210, the data driving circuit may obtain a current brightness value of each of the plurality of the compensation regions. In an embodiment, a number of sample images may be displayed on the display screen. The displayed sample images and the number of the sample images may be determined according to a first brightness compensation algorithm used by the data driving circuit. The first brightness compensation algorithm may be used to calculate, for each of the compensation regions, the compensated grey value for the compensation region. The sample image may be, for example, a primary color image or a grey-level image with a sample grey value. Then the sample images displayed on the display screen may be captured by an image capturing device (for example, a high-definition camera), respectively. The captured sample images are provided to the data driving circuit. For each of the sample images displayed, the data driving circuit may use an image processing formula to calculate a current brightness value of each pixel unit of the sample image. Then the current brightness value may be determined for each of the compensation regions. In an embodiment, if the compensation region includes one pixel unit, the current brightness value of the compensation region may be determined as the current brightness value of the corresponding pixel unit. In another embodiment, if the compensation region includes a plurality of pixel units, the current brightness value of the compensation region may be determined as a function of the current brightness values of the corresponding plurality of pixel units, such as an average value, a weighted average value, or a maximum value of the current brightness values of the corresponding plurality of pixel units.

After obtaining the current brightness value of each compensation region, at step 220, the data driving circuit may generate the first brightness compensation data based on the respective current brightness values and the respective desired brightness values of the plurality of compensation regions using the first brightness compensation algorithm. In an embodiment of the present disclosure, the first brightness compensation algorithm may be expressed as a first brightness compensation formula. The first brightness compensation formula may represent a function between the compensated grey value and the original grey value. For example, the first brightness compensation formula may be expressed as $Y=aX+b$, where X represents the original grey value, Y represents the compensated grey value, and a and b represent coefficients respectively. It should be noted that the first brightness compensation formula is shown herein by way of example only for understanding the present disclosure, and is not intended to limit. In an embodiment of the present disclosure, the desired brightness value of each compensation region may be determined according to the sample grey value of the compensation region of the sample image and a desired grey value-brightness diagram for the display screen. If the compensation region includes one pixel unit, the grey value of the compensation region may be determined as the grey value of the corresponding pixel unit. If the compensation region includes a plurality of pixel units, the grey value of the compensation region may be determined as a function of the grey values of the corresponding plurality of pixel units, such as an average grey value, a weighted average grey value, or a maximum grey value of the grey values of the corresponding plurality of pixel units. Then the data driving circuit may determine the desired brightness value of each compensation region from the desired grey value-brightness diagram according to the sample grey value of the compensation region. Based on the current brightness value and the desired brightness value of each compensation region, the coefficients a and b of the first brightness compensation formula for the compensation region can be calculated, thereby generating the specific first brightness compensation formula to the compensation region. Then the data driving circuit may use the specific first brightness compensation formula to calculate the compensated grey value corresponding to the sample grey value of the compensation region. Then the data driving circuit may establish a correspondence between the sample grey value and the compensated grey value of the respective compensation regions as the first brightness compensation data.

In some embodiments, if the original grey value includes all grey values in a certain grey-scale level, the data driving circuit may calculate the compensated grey values corresponding to all the grey values for each compensation region in accordance with the process as shown in FIG. 2, thereby, establishing the correspondence between all the grey values and the compensated grey values of the respective compensation regions as the first brightness compensation data.

Returning back to FIG. 1, at step 120, when an image is to be displayed, the data driving circuit may adjust the image data according to the received first brightness compensation data. In an embodiment of the present disclosure, the data driving circuit may obtain the grey values of the plurality of compensation regions according to the image data. If the compensation region includes one pixel unit, the grey value of the compensation region may be determined as the grey value of the corresponding pixel unit. If the compensation region includes a plurality of pixel units, the grey value of the compensation region may be determined as a function of the grey values of the corresponding plurality of pixel units, such as an average grey value, a weighted average grey value, or a maximum grey value of the grey values of the corresponding plurality of pixel units. Then the data driving circuit may adjust the grey value of each compensation region using the first brightness compensation data to obtain the compensated grey value. If the first brightness compensation data is directed to all grey values in a grey-scale level, the data driving circuit may adjust the grey value of each compensation region directly using the first brightness compensation data. If the first brightness compensation data is directed to the sample grey value, the data driving circuit may calculate, for each compensation region, the coefficients a and b of the first brightness compensation formula using the first brightness compensation data, thereby obtaining the specific first brightness compensation formula to the compensation region. Then the data driving circuit may calculate the compensated grey value for each compensation region based on the grey value of the compensation region using the specific first brightness compensation formula. Further the data driving circuit may obtain the compensated image data based on the compensated grey value of each compensation region. Then the data driving circuit may drive the display screen to display the image according to the compensated image data.

With the method according to the embodiments as above, the brightness compensation can be quickly implemented to eliminate the brightness evenness for the display device by storing the first brightness compensation data in the mainboard and providing the first brightness compensation data to the data driving circuit via the MIPI-based interface. Furthermore, with the method according to the embodiments as above, the data storage space can be increased and the additional storage device of the data driving circuit can be removed so as to reduce the cost of the display device.

Figure 3:
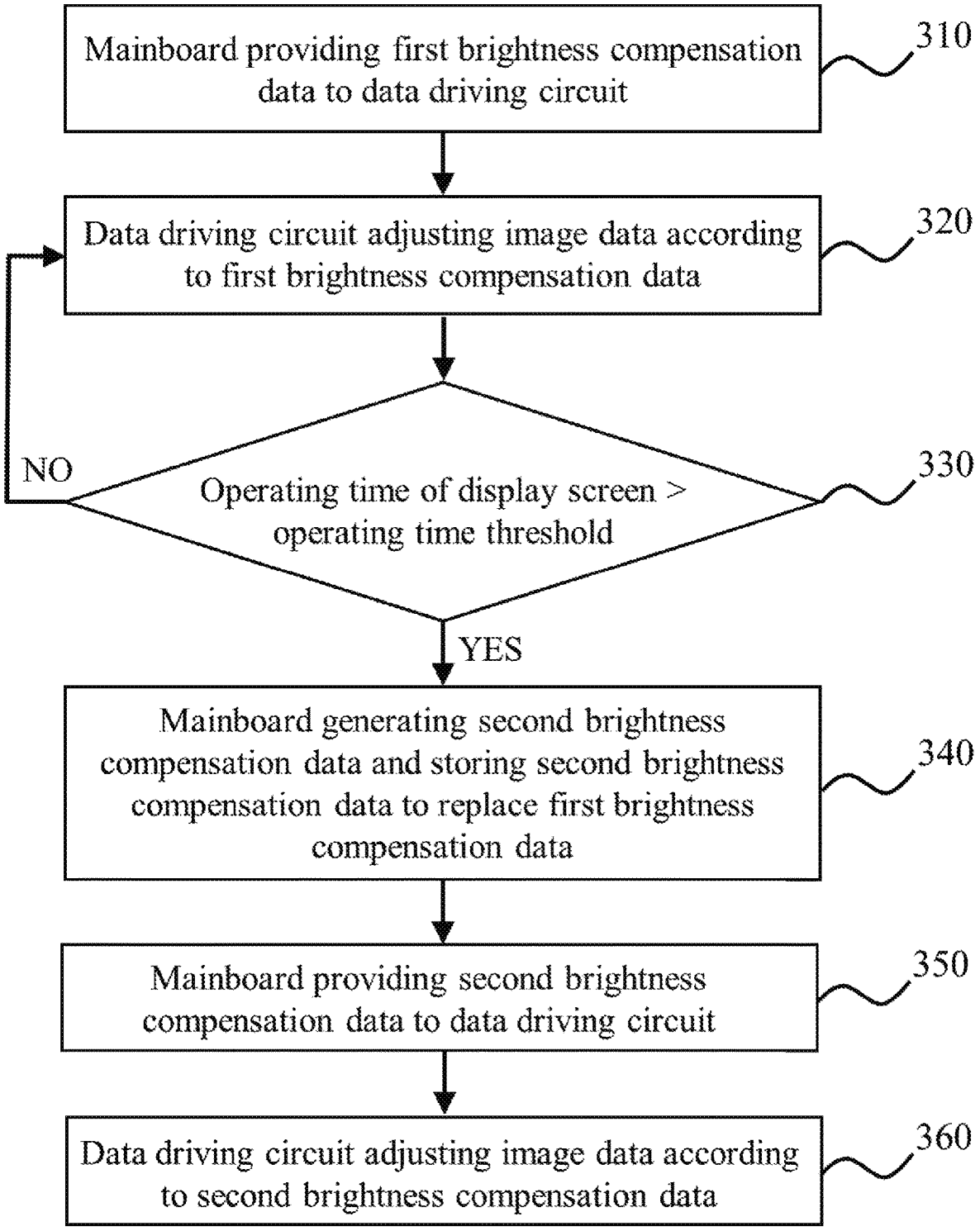
FIG. 3 is a schematic flowchart of a method for compensating brightness unevenness of a display device according to another embodiment of the present disclosure.

FIG. 3 schematically illustrates a flowchart of a method for compensating brightness unevenness of a display device according to an embodiment of the present disclosure. Next the method according to the embodiment will be described in detail with reference to the drawing.

When the display screen has operated for a long time, the driving transistor alternates charging and discharging with high-frequency for a long time, and thus the threshold voltage of the driving transistor will drift positively, resulting in the decrease of the driving voltage. In addition, during the operation of the light emitting device, as the operating temperature changes, the driving current through the light emitting device will be decreased, resulting in the decrease of the light emitting brightness. Therefore, the brightness of the display screen will be attenuated over time. In view of the above, in the embodiment, in addition to the brightness compensation, the brightness attenuation caused by the long-time operation of the display screen will be compensated.

In the embodiment, in addition to storing the first brightness compensation data, the mainboard may record and store the operating time of the display screen. Furthermore, the mainboard may store a threshold voltage drift characteristic of the driving transistor and a light emission attenuation characteristic of the light emitting device of the display screen. The threshold voltage drift characteristic of the driving transistor may be represented by a relationship curve between an operating time and a driving voltage. The light emission attenuation characteristic of the light emitting device may be represented by a relationship curve between an operating time and brightness under a specific driving voltage.

As shown in FIG. 3, at step 310, when the display device is started, the mainboard may provide the first brightness compensation data to the data driving circuit. Then at step 320, the data driving circuit may adjust the image data according to the received first brightness compensation data when the image is to be displayed. At step 330, the mainboard may detect whether the operating time of the display screen reaches the operating time threshold. If the operating time of the display screen does not reach the operating time threshold, the process returns back to step 320, and the data driving circuit continues using the first brightness compensation data to adjust the image data.

If the operating time of the display screen reaches the operating time threshold, at step 340, the mainboard may generate the second brightness compensation data and stores the second brightness compensation data to replace the first brightness compensation data.

In an embodiment of the present disclosure, the mainboard may generate the third brightness compensation data based on the threshold voltage drift characteristic of the driving transistor and the light emission attenuation characteristic of the light emitting device of the display screen using a second brightness compensation algorithm stored in the mainboard, as a supplement to the first brightness compensation data. In the embodiment of the present disclosure, the second brightness compensation algorithm is different from the first brightness compensation algorithm. In an embodiment, the second brightness compensation algorithm may be expressed as a second brightness compensation formula which represents a function between the compensated grey-level and the original grey-level.

For example, the second brightness compensation formula can be expressed as $Y'=cX'+d$, where $X'$ represents the original grey value, $Y'$ represents the compensated grey value, and c and d represent coefficients respectively. It should be noted that the second brightness compensation formula is shown herein by way of example only for understanding the present disclosure, and is not intended to limit.

For each compensated grey value of the first brightness compensation data (hereinafter referred to as "initial compensated grey value"), the mainboard may determine the current driving voltage corresponding to the operating time of the display screen according to the threshold voltage drift characteristic of the driving transistor. Then the mainboard may determine the current brightness of the display screen according to the light emission attenuation characteristic of the light emitting device based on the current driving voltage and the operating time of the display screen. Further, the mainboard may determine the desired brightness of the display screen according to the initial compensated grey value and the desired grey value-brightness diagram of the display screen. Then the mainboard may calculate the coefficients c and d of the second brightness compensation formula based on the desired brightness and the current brightness of the display screen, thereby generating the specific second brightness compensation formula. Then the mainboard may calculate a second-compensated grey value corresponding to the initial compensated grey value using the specific second brightness compensation formula, so as to establish a correspondence between the second-compensated grey value and the initial compensated grey value, as third brightness compensation data. Further, the mainboard may establish a correspondence between the original grey value and the second-compensated grey value according to the first brightness compensation data and the third brightness compensation data, thereby generating and storing the second brightness compensation data to replace the first brightness compensation data.

In an embodiment of the present disclosure, a plurality of operating time thresholds may be set. In this case, each time when the operating time of the display screen reaches one of the plurality of operating time thresholds, the mainboard will generate and store the second brightness compensation data by performing step 340 described above.

At step 350, the mainboard may provide the second brightness compensation data to the data driving circuit. In an embodiment of the present disclosure, the mainboard may provide the second brightness compensation data to the data driving circuit when the display device is restarted after the second brightness compensation data is generated. Alternatively, the mainboard may provide the second brightness compensation data to the data driving circuit immediately after the second brightness compensation data is generated. Then, at step 360, the data driving circuit may adjust the image data according to the received second brightness compensation data. If the second brightness compensation data is directed to all grey values in a certain grey-scale level, the data driving circuit may adjust the grey value of each compensation region directly using the second brightness compensation data. If the second brightness compensation data is directed to the sample grey value, the data driving circuit may calculate the coefficients a and b of the first brightness compensation formula for each compensation region using the second brightness compensation data, thereby obtaining the specific first brightness compensation formula to the compensation region. Then the data driving circuit may calculate, for each compensation region, the compensated grey value based on the grey value of the compensation region using the specific first brightness compensation formula. Further, the data driving circuit may obtain the compensated image data based on the compensated grey values of the respective compensation regions. Then the data driving circuit may drive the display screen to display the image according to the compensated image data.

Figure 4:
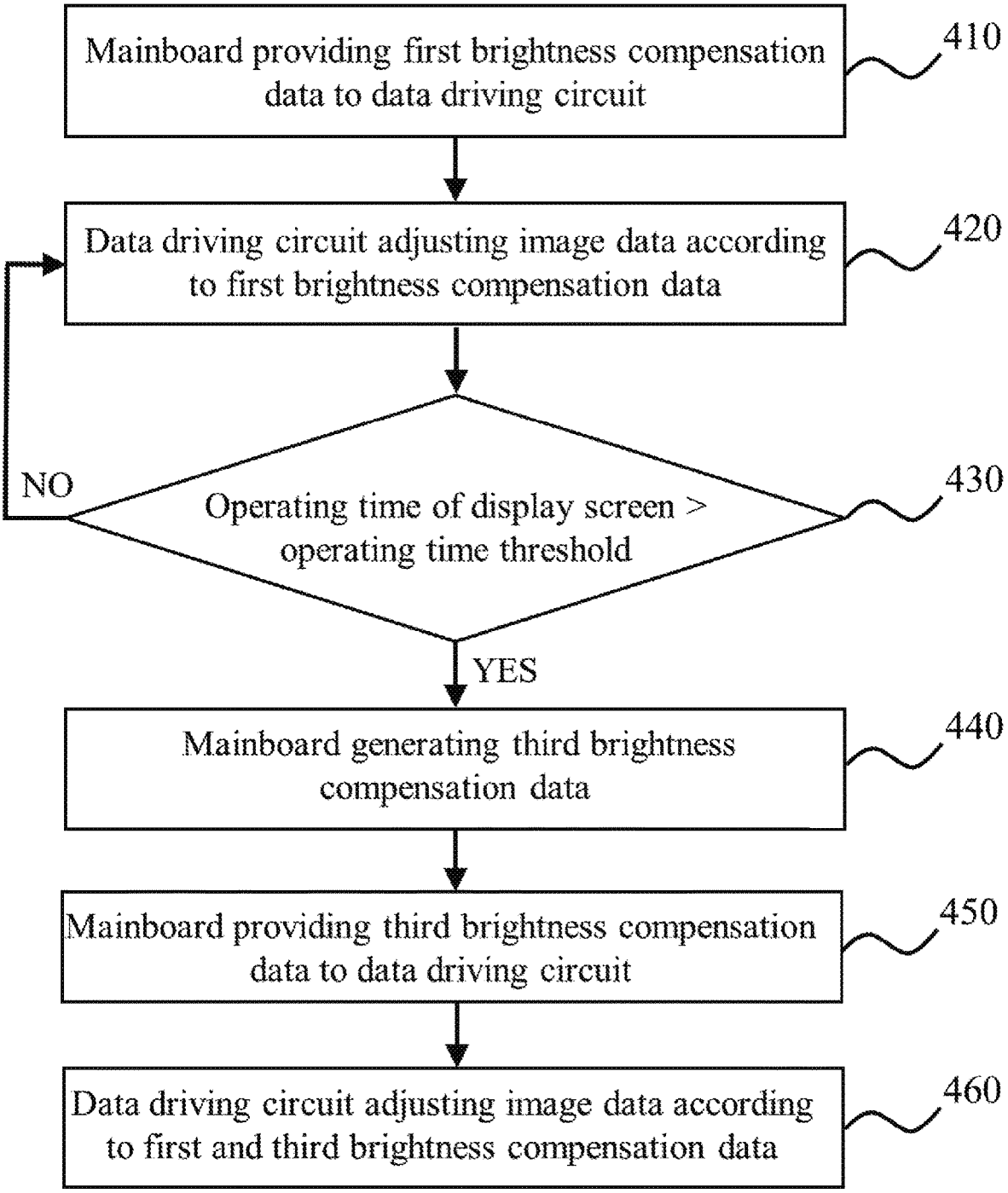
FIG. 4 is a schematic flowchart of a method for compensating brightness unevenness of a display device according to yet another embodiment of the present disclosure.

FIG. 4 schematically illustrates a flowchart of the method for compensating brightness unevenness of the display device according to an embodiment of the present disclosure. This embodiment differs from the embodiment shown in FIG. 3 in that the mainboard generates and stores the third brightness compensation data when the operating time of the display screen reaches the operating time threshold.

In FIG. 4, steps 410, 420, and 430 are similar to steps 310, 320, and 330, respectively, and detailed descriptions thereof are omitted here. Then, at step 440, if the operating time of the display screen reaches the operating time threshold, the mainboard may generate and store the third brightness compensation data. In the embodiment of the present disclosure, as described above, the mainboard may generate the third brightness compensation data according to the threshold voltage drift characteristic of the driving transistor and the light emission attenuation characteristic of the light emitting device using the second brightness compensation algorithm.

At step 450, the mainboard may provide the third brightness compensation data to the data driving circuit. In an embodiment of the present disclosure, the mainboard may provide the first brightness compensation data and the third brightness compensation data to the data driving circuit together when the display device is restarted after the third brightness compensation data is generated. Alternatively, the mainboard may provide the third brightness compensation data to the data driving circuit immediately after the third brightness compensation data is generated. Then, at step 460, the data driving circuit may adjust the image data to determine the compensated image data according to the first and third brightness compensation data. Then the data driving circuit may drive the display screen to display the image according to the compensated image data.

In an embodiment of the present disclosure, when adjusting the image data, the data driving circuit may obtain the grey value of each compensation region according to the image data. Then the data driving circuit may adjust the grey values of the respective compensation regions according to the first and third brightness compensation data to determine the compensated image data. If the first brightness compensation data and the third brightness compensation data are directed to the sample grey value, the data driving circuit may calculate the coefficients of the first brightness compensation formula for each compensation region using the first and third brightness compensation data. Then the data driving circuit may obtain, for each compensation region, the compensated grey value based on the grey value of the compensation region using the specific first brightness compensation formula to the compensation region. If the first and third brightness compensation data are directed to all grey values in a certain grey-scale level, for each compensation regions, the data driving circuit may adjust the grey value using the first brightness compensation data to determine the initial compensated grey value, and then adjust the initial compensated grey value using the third brightness compensation data to obtain the compensated grey value of the compensation region.

Figure 5:
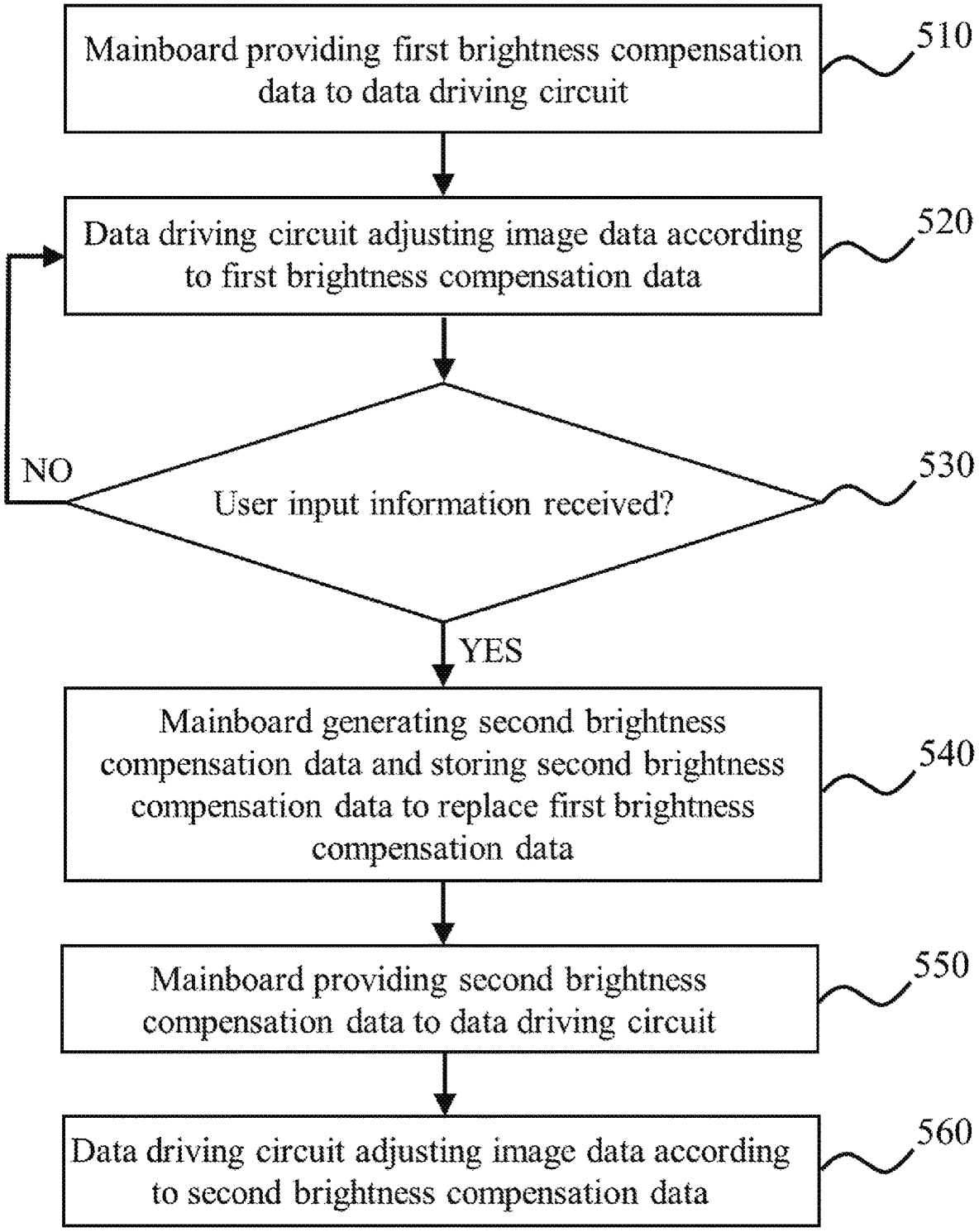
FIG. 5 is a schematic flowchart of a method for compensating brightness unevenness of a display device according to yet another embodiment of the present disclosure.

FIG. 5 schematically illustrates a flowchart of the method for compensating brightness unevenness of a display device according to an embodiment of the present disclosure. In an embodiment, the brightness compensation data is updated based on user input information.

As shown in FIG. 5, at step 510, the mainboard may provide the first brightness compensation data to the data driving circuit when the display device is started. Then, at step 520, the data driving circuit may adjust the image data according to the received first brightness compensation data when the image is to be displayed. The steps 510 and 520 are similar to the steps 310 and 320 in the embodiment above, respectively.

Further, at step 530, the mainboard may detect whether the user input information from a user is received. In an embodiment of the present disclosure, the user input information may indicate a start to update the brightness compensation data. If no user input information is received, the process returns back to step 520, and the data driving circuit continues using the first brightness compensation data to adjust the image data. If the user input information is received, at step 540, the mainboard may generate and store the second brightness compensation data to replace the first brightness compensation data. The generation of the second brightness compensation data has been described in detail in the embodiments above, and thus the description thereof is omitted here. In addition, in an embodiment of the present disclosure, the user input information may indicate a region for which the brightness compensation data is to be updated. In this case, the mainboard may generate the second brightness compensation data for the compensation region(s) corresponding to the indicated region. Then the second brightness compensation data is stored in the mainboard to replace the first brightness compensation data.

In an embodiment of the present disclosure, the user input information may be obtained through an interaction interface provided in the display device.

Then, at step 550, the mainboard may provide the second brightness compensation data to the data driving circuit. As described above, the mainboard may provide the second brightness compensation data to the data driving circuit immediately or when the display device is restarted after the second brightness compensation data is generated. Then, at step 560, the data driving circuit may adjust the image data to determine the compensated image data according to the second brightness compensation data when the image is to be displayed. Then the data driving circuit may drive the display screen to display the image according to the compensated image data.

Figure 6:
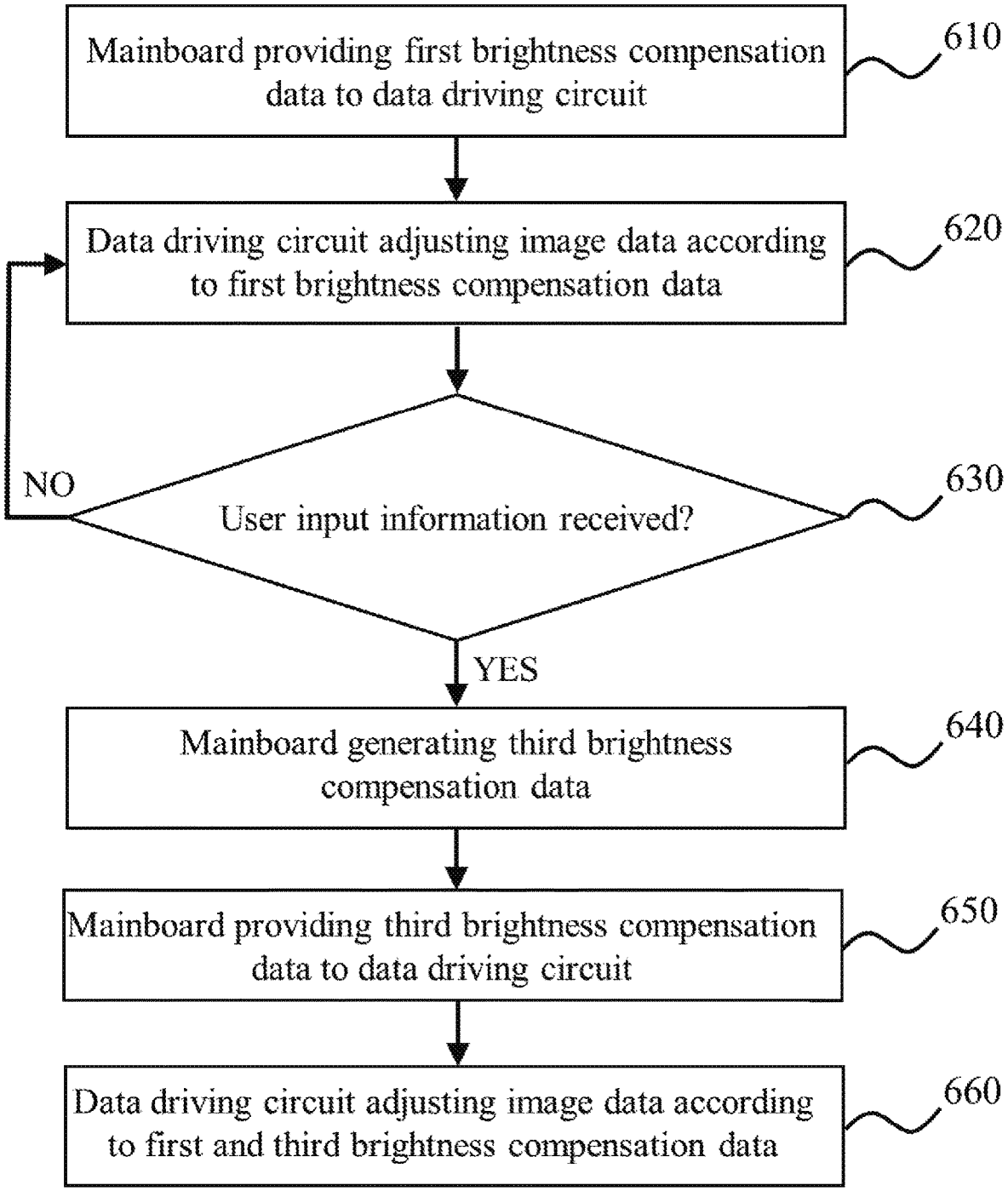
FIG. 6 is a schematic flowchart of a method for compensating brightness unevenness of a display device according to yet another embodiment of the present disclosure.

FIG. 6 schematically illustrates a flowchart of the method for compensating brightness unevenness of a display device according to an embodiment of the present disclosure. This embodiment differs from the embodiment shown in FIG. 5 in that the mainboard generates and stores the third brightness compensation data according to the user input information.

In FIG. 6, the steps 610, 620, and 630 are similar to the steps 510, 520, and 530, respectively. If the mainboard receives the user input information, at step 640, the mainboard may generate the third brightness compensation data. If the user input information indicates the start to update the brightness compensation data, the mainboard may generate the third brightness compensation data for each compensation region. If the user input information also indicates a region for which the brightness compensation data is to be updated, the mainboard may generate the third brightness compensation data only for the compensation region(s) corresponding to the indicated region.

Then, at step 650, the mainboard may provide the generated third brightness compensation data to the data driving circuit. As described above, the mainboard may provide the first brightness compensation data and the third brightness compensation data to the data driving circuit together immediately or when the display device is restarted after the third brightness compensation data is generated. Then, at step 660, the data driving circuit may adjust the image data according to the first and third brightness compensation data when the image is to be displayed.

With the methods according to the embodiments described with reference to FIGS. 3 to 6, the brightness unevenness and the brightness attenuation due to the long-time operation of the display screen can be compensated, thereby further improving the display quality of the display device.

Figure 7:
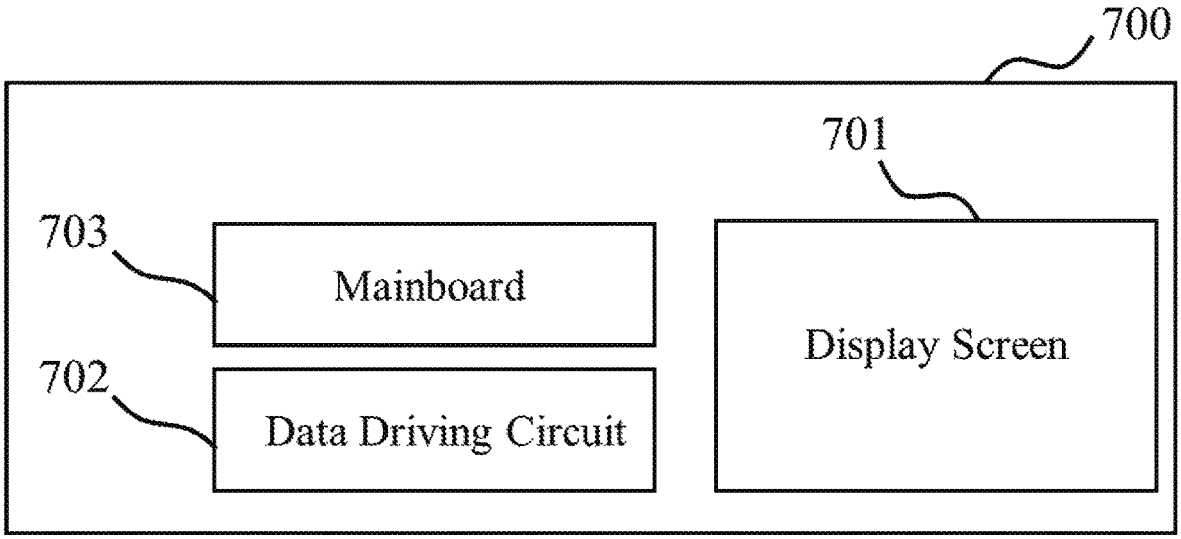
FIG. 7 is a schematic diagram of a display device according to an embodiment of the present disclosure.

FIG. 7 is a schematic diagram of the display device 700 according to an embodiment of the present disclosure. In this embodiment, the display device 700 can implement the method of compensating brightness unevenness as described above with reference to FIG. 1 and FIGS. 3 to 6.

As shown in FIG. 7, the display device 700 may include a display screen 701, a data driving circuit 702 coupled to the display screen 701, and a mainboard 703 coupled to the data driving circuit 702. The mainboard 703 may store the first brightness compensation data. The data driving circuit 702 may obtain the first brightness compensation data from the mainboard 703, and adjust the image data based on the first brightness compensation data when the image is to be displayed, and drive the display screen to display the image.

Further, the mainboard 703 may be configured to update the first brightness compensation data when the operating time of the display screen reaches the operating time threshold or according to the user input information. Then the data driving circuit 702 may adjust the image data according to the second brightness compensation data when the image is to be displayed.

In an embodiment of the present disclosure, the display device may be, for example, a mobile phone, a tablet computer, a camera, a wearable device, or the like.

Several embodiments of the present disclosure have been described above in detail, but they are presented by way of example only and are not intended to limit the scope of the disclosure. In fact, the embodiments described herein may be implemented in various other forms. In addition, various omissions, replacements, and modifications to the embodiments described herein may be made without departing from the spirit of the present disclosure. The appended claims and their equivalents are intended to cover such forms or modifications that fall within the scope and spirit of the present disclosure.

What is claimed is:

1. A method for compensating brightness unevenness of a display device, the display device comprising a display screen, a data driving circuit, and a mainboard, wherein the mainboard has first brightness compensation data for the display screen stored therein, the method comprising:

obtaining, by the data driving circuit, the first brightness compensation data from the mainboard; and adjusting, by the data driving circuit, image data according to the first brightness compensation data, wherein the display screen is divided into a plurality of compensation regions, wherein the data driving circuit generates the first brightness compensation data by:

obtaining a current brightness value of each of the plurality of compensation regions; and generating the first brightness compensation data based on a first brightness compensation formula:

$Y=aX+b$, where X represents an original grey value of the image data, Y represents the compensated grey value, and a and b represent coefficients based on the respective current brightness values and respective desired brightness values of the plurality of compensation regions; and wherein the generated first brightness compensation data is stored in the mainboard.

2. The method according to claim 1, further comprising:

generating, by the mainboard, second brightness compensation data and storing the second brightness compensation data to replace the first brightness compensation data when operating time of the display screen reaches an operating time threshold;

wherein the data driving circuit obtains the second brightness compensation data from the mainboard, and adjusts the image data according to the second brightness compensation data.

3. The method according to claim 1, further comprising:

generating and storing, by the mainboard, third brightness compensation data, when operating time of the display screen reaches an operating time threshold;

wherein the data driving circuit obtains the first brightness compensation data and the third brightness compensation data from the mainboard, and adjusts the image data according to the first brightness compensation data and the third brightness compensation data.

4. The method according to claim 1, further comprising:

generating, by the mainboard, second brightness compensation data and storing the second brightness compensation data to replace first brightness compensation data, in response to user input information, wherein the data driving circuit obtains the second brightness compensation data from the mainboard, and adjusts the image data according to the second brightness compensation data.

5. The method according to claim 1, further comprising:

generating, by the mainboard, third brightness compensation data, in response to user input information, wherein the data driving circuit obtains the first brightness compensation data and the third brightness compensation data from the mainboard, and adjusts the image data according to the first brightness compensation data and the third brightness compensation data.

6. The method according to claim 4, wherein the user input information indicates a start to update brightness compensation data.

7. The method according to claim 6, wherein the user input information further indicates a region for which the brightness compensation data is to be updated.

8. The method according to claim 2, wherein generating, by the mainboard, the second brightness compensation data comprises:

generating third brightness compensation data based on a threshold voltage drift characteristic of a driving transistor of the display screen and a light emission attenuation characteristic of a light emitting device of the display screen; and generating the second brightness compensation data based on the first brightness compensation data and the third brightness compensation data.

9. The method according to claim 3, wherein the mainboard generates the third brightness compensation data based on a threshold voltage drift characteristic of a driving transistor of the display screen and a light emission attenuation characteristic of a light emitting device of the display screen.

10. A display device comprising:

a display screen, a mainboard, and a data driving circuit, wherein the mainboard is configured to store first brightness compensation data for the display screen;

wherein the data driving circuit is configured to obtain the first brightness compensation data from the mainboard, and adjust image data according to the first brightness compensation data;

wherein the display screen is divided into a plurality of compensation regions, and wherein the data driving circuit is configured to generate the first brightness compensation data by:

obtaining a current brightness value of each of the plurality of compensation regions; and generating the first brightness compensation data based on a first brightness compensation formula:

$Y=aX+b$, where X represents an original grey value of the image data, Y represents the compensated grey value, and a and b represent coefficients based on the respective current brightness values and respective desired brightness values of the plurality of compensation regions; and wherein the generated first brightness compensation data is stored in the mainboard.

11. The display device according to claim 10, wherein the mainboard is further configured to generate second brightness compensation data and store the second brightness compensation data to replace the first brightness compensation data, when operating time of the display screen reaches an operating time threshold; and wherein the data driving circuit is further configured to obtain the second brightness compensation data from the mainboard, and adjust the image data according to the second brightness compensation data.

12. The display device according to claim 10, wherein the mainboard is further configured to generate and store third brightness compensation data, when operating time of the display screen reaches an operating time threshold; and wherein the data driving circuit is further configured to obtain the first brightness compensation data and the third brightness compensation data from the mainboard, and adjust the image data according to the first brightness compensation data and the third brightness compensation data.

13. The display device according to claim 10, wherein the mainboard is further configured to generate second brightness compensation data and store the second brightness compensation data to replace the first brightness compensation data, in response to user input information, and wherein the data driving circuit is further configured to obtain the second brightness compensation data from the mainboard, and adjust the image data according to the second brightness compensation data.

14. The display device according to claim 10, wherein the mainboard is configured to generate and store third brightness compensation data in response to user input information, and wherein the data driving circuit is further configured to obtain the first brightness compensation data and the third brightness compensation data from the mainboard, and adjust the image data according to the first brightness compensation data and the third brightness compensation data.

15. The display device according to claim 13, wherein the user input information indicates a start to update brightness compensation data.

16. The display device according to claim 15, wherein the user input information further indicates a region for which the brightness compensation data is to be updated.

17. The display device according to claim 11, wherein the mainboard is further configured to generate the third brightness compensation data based on a threshold voltage drift characteristic of a driving transistor of the display screen and a light emission attenuation characteristic of a light emitting device of the display screen, and generate the second brightness compensation data based on the first brightness compensation data and the third brightness compensation data.

18. The display device according to claim 12, wherein the mainboard is further configured to generate the third brightness compensation data based on a threshold voltage drift characteristic of a driving transistor of the display screen and a light emission attenuation characteristic of a light emitting device of the display screen.

* * * * *